US011668546B2

(12) United States Patent
Peterson et al.

(10) Patent No.: US 11,668,546 B2
(45) **Date of Patent: *Jun. 6, 2023**

(54) MUZZLELOADER POWER CELL WITH PRIMER

(71) Applicant: Vista Outdoor Operations LLC, Anoka, MN (US)

(72) Inventors: Bryan P. Peterson, Isanti, MN (US); Drew L. Goodlin, Isanti, MN (US); Adam J. Moser, Big Lake, MN (US)

(73) Assignee: Federal Cartridge Company, Anoka, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/490,404

(22) Filed: Sep. 30, 2021

(65) Prior Publication Data

US 2022/0107157 A1 Apr. 7, 2022

Related U.S. Application Data

(63) Continuation of application No. 16/686,130, filed on Nov. 16, 2019, now Pat. No. 11,137,229.
(Continued)

(51) Int. Cl.
*F41C 9/08* (2006.01)
*F41A 3/58* (2006.01)
(Continued)

(52) U.S. Cl.
CPC ..... *F41C 9/08* (2013.01); *F41A 3/58* (2013.01); *F41A 3/74* (2013.01); *F42B 5/38* (2013.01)

(58) Field of Classification Search
CPC ..... F41A 3/12; F41A 3/58; F41A 3/60; F41A 3/74; F41A 3/76; F41C 9/08; F42B 5/38
(Continued)

(56) References Cited

U.S. PATENT DOCUMENTS 2,655,755 A * 10/1953 Nichols ..... F42B 8/06 42/65
3,673,965 A 7/1972 Herter
(Continued)

FOREIGN PATENT DOCUMENTS

GB 463628 A 4/1937

OTHER PUBLICATIONS

Search Report and Written Opinion—Spain Application No. 202190043, dated May 31, 2022.
(Continued)

*Primary Examiner* — John Cooper
(74) *Attorney, Agent, or Firm* — Reed Smith LLP; Matthew P. Frederick; Travis J. Sumpter

(57) ABSTRACT

Muzzleloader systems including a pre-packaged propellant charge with a primer and receptacle. The muzzleloader system may include a propellant containment vessel separate from the primer and the projectile and that doesn't contact with the projectile until assembly. The muzzleloader may be rear loading, with a constriction portion forward of the breech chamber. The propellant containment vessel may include a body portion having a forward opening, with a propellant charge disposed therein and a cap portion that is crimp rolled within the mouth of the vessel to seal the forward opening. The closed end of the propellant containment vessel may define a primer receptacle configured to receive the primer. The receptacle may define a depth that is less than the primer height so that, when inserted into the receptacle, the primer extends rearwardly beyond the containment vessel. The muzzleloader system may be configured to fire only specifically configured propellant containment vessels.

25 Claims, 10 Drawing Sheets

Related U.S. Application Data

(60) Provisional application No. 62/794,669, filed on Jan. 20, 2019.

(51) Int. Cl.
*F41A 3/74* (2006.01)
*F42B 5/38* (2006.01)

(58) Field of Classification Search
USPC ..... 42/51
See application file for complete search history.

(56) References Cited

U.S. PATENT DOCUMENTS 3,780,464 A * 12/1973 Anderson ..... F41C 9/08 42/51
3,877,375 A * 4/1975 Barr ..... F42C 19/10 102/470
4,437,249 A * 3/1984 Brown ..... F41C 9/08 42/51
4,715,139 A * 12/1987 Rodney, Jr. ..... F41C 9/08 42/86
5,010,677 A * 4/1991 Verney Carron ..... F41C 9/08 102/446
6,314,670 B1 * 11/2001 Rodney, Jr. ..... F41C 9/08 89/27.13
RE37,968 E * 1/2003 Osborne ..... F41C 9/08 89/27.13
6,604,311 B1 * 8/2003 Laney ..... F41A 3/06 42/51
6,612,063 B1 * 9/2003 Sigg ..... F41A 3/12 42/1.07
6,647,653 B1 * 11/2003 Hengstenberg ..... F41C 9/08 42/51
6,996,930 B2 * 2/2006 Hengstenberg ..... F41A 19/57 89/27.13
10,119,799 B2 * 11/2018 Kuchman ..... F42B 5/26
2011/0000118 A1 * 1/2011 Richards ..... F41A 3/74 42/51
2014/0076188 A1 3/2014 Maljkovic
2014/0090284 A1 * 4/2014 Peterson ..... F41C 7/11 42/51
2016/0305729 A1 * 10/2016 Martin ..... F41A 17/64
2018/0017348 A1 * 1/2018 Brown ..... F41A 3/12
2018/0134414 A1 5/2018 Alikouhi
2018/0224229 A1 8/2018 Teach, Jr. et al.
2019/0003801 A1 * 1/2019 Ibarguren ..... F41C 9/08
2021/0055068 A1 * 2/2021 Calvete ..... F41C 9/08
2022/0099417 A1 * 3/2022 Calvete ..... F42B 5/26

OTHER PUBLICATIONS

International Search Report and Written Opinion for PCT/US2020/014353.

* cited by examiner

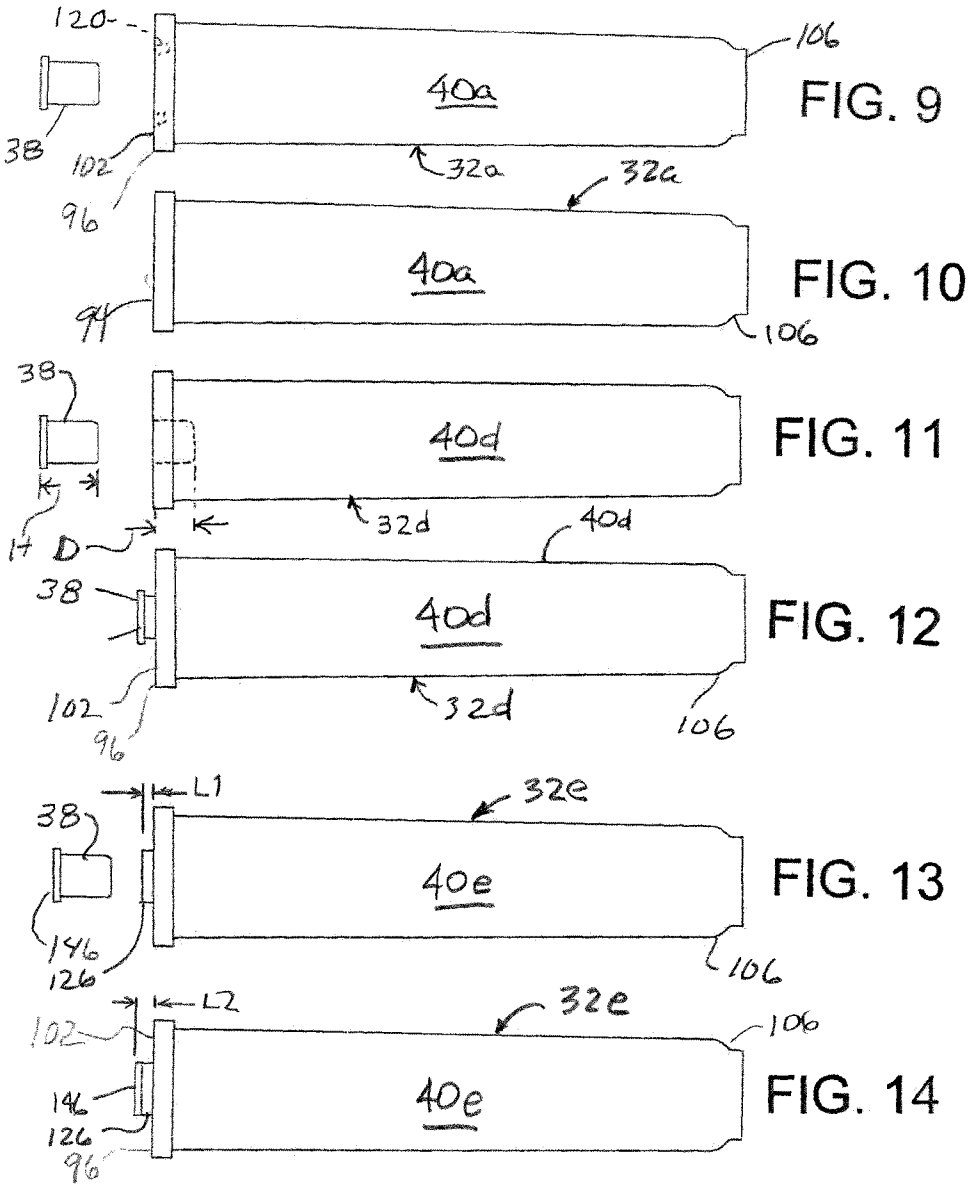
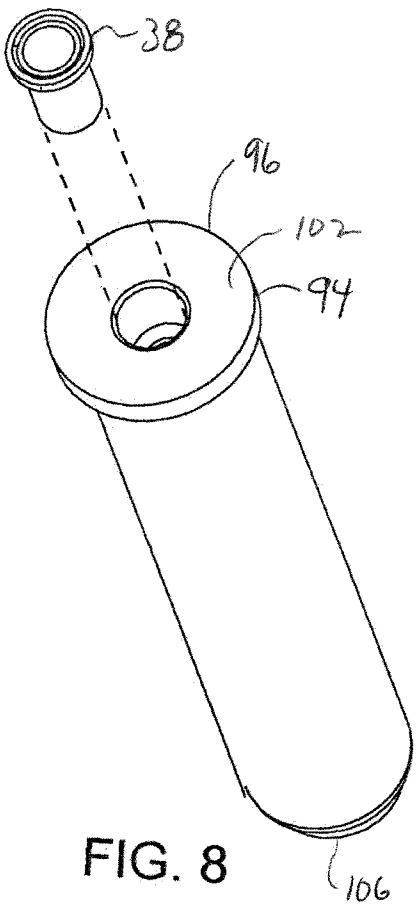
FIG. 8

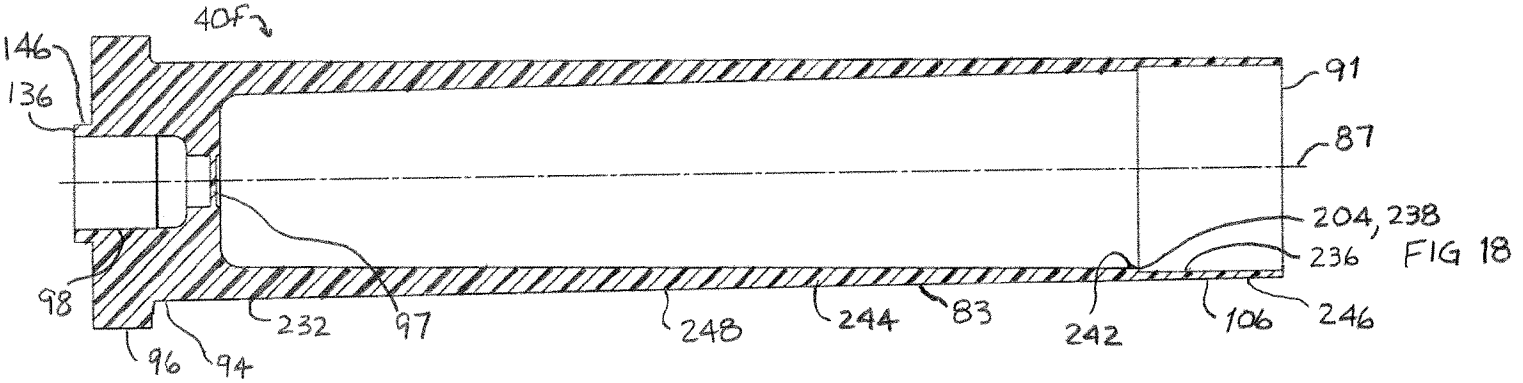
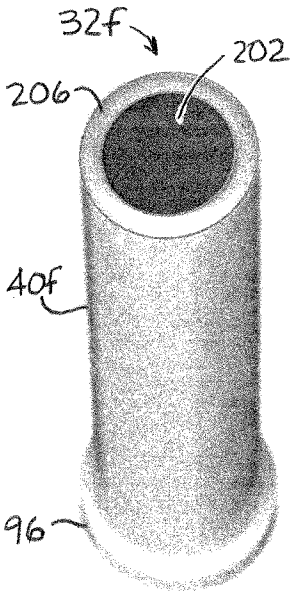
FIG. 20
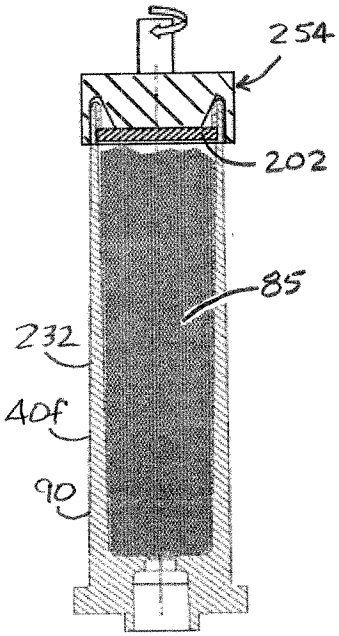
FIG. 19C
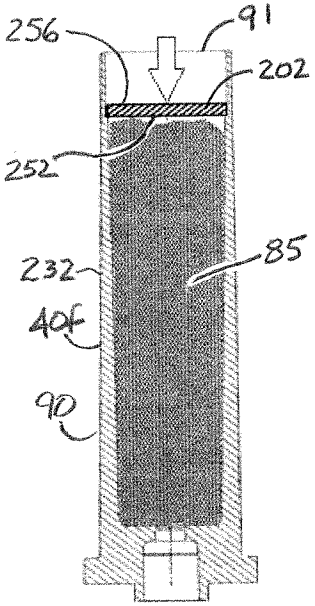
FIG. 19B
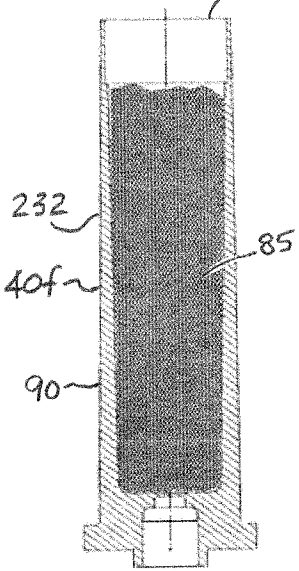
FIG. 19A

MUZZLELOADER POWER CELL WITH PRIMER

RELATED APPLICATIONS

This application is continuation of U.S. patent application Ser. No. 16/686,130, filed Nov. 16, 2019, which claims the benefit of U.S. Provisional Patent Application No. 62/794,669, filed Jan. 20, 2019, the disclosures of each are hereby incorporated by reference herein in their entirety.

BACKGROUND

Muzzleloaders are a class of firearms in which the propellant charge and bullet are separately loaded into the barrel immediately prior to firing. Unlike modern breech loaded firearms where the bullet, propellant charge and primer are loaded as prepackaged cartridges, muzzleloaders are loaded by feeding a propellant charge through the muzzle of the barrel before ramming a bullet down the barrel with a ramrod until the bullet is seated against the propellant charge at the breech end of the barrel. A primer is inserted at the breech to be in communication with the propellant. The primer is then struck by an inline firing pin or an external hammer to ignite the propellant charge to create propellant gases for propelling the bullet.

A variability in muzzleloaders not present in cartridge based firearms is the quantity and type of the propellant charge. Unlike cartridge firearms where a cartridge is preloaded with a bullet and premeasured quantity of propellant is loaded into the firearm for firing, the bullet and propellant charge are combined within the firearm for firing. Accordingly, the muzzleloader operator can select the optimal bullet, propellant type and quantity combination for each shot, which is particularly advantageous given the long reloading time for muzzleloaders. While the variability of the bullet—propellant charge combination allows for an optimized shot, varying the bullet and in particular the propellant and quantity of propellant can significantly change the appropriate seating depth of the bullet. With loose or powdered propellant such as black powder, the amount of propellant is often varied between 80 and 120 volumetric grains. Similarly, propellants are often formed into cylindrical pellets that are stacked end-to-end within the barrel to form the propellant charges. The pellets are typically each about 1 cm in length and loaded in 1 to 3 pellet groups causing an even greater variation in the seating depth. Of course, variability in the powder, bullet, and seating depth causes variability in performance, including accuracy.

Another safety concern unique to muzzleloaders is an undersized or oversized propellant charge. Unlike cartridge firearms where the amount of propellant loaded for each shot is limited by the internal volume of the cartridge, theoretically, the amount of propellant loaded for each shot in muzzleloaders is only limited by the length of the barrel. While measures are often used to provide a constant quantity of propellant for each propellant charge, the measures can be difficult to use in the field or in low ambient light when hunting often occurs. Similarly, propellant can be formed into the pre-sized pellets that can be loaded one at a time until the appropriate amount of propellant is loaded. As with measuring the quantity of powder, errors can occur in loading the appropriate number of pellets. Embodiments of the disclosure address the above issues.

SUMMARY OF THE DISCLOSURE

All conventional firearms are designed and built and chambered to fire a single size of ammunition. Incorrectly sized ammunition should not properly seat in the chamber and otherwise not allow for firing same. Breech action firearms such as single fire shotguns and double barrel shotguns conventionally have a planar breech block face with a central firing pin hole with a planar breech block face. Muzzleloading systems featuring breech loaded and sealed propellant cartridges have been developed by the owner of the instant application and have been disclosed as having a planar breech block face. See, for example, U.S. Pat. No. 10,030,956, incorporated by reference herein except for express definitions and patent claims contained therein. The applicant has developed non-conventional interface systems between the breech block face and cartridges providing a high level of certainty that only intended propellant vessels can be fired in the muzzleloader.

In some embodiments of the disclosure, a muzzleloader system has a muzzleloader rifle having a barrel with a breech chamber that opens rearwardly, a constriction portion forward of the breech chamber, and a barrel bore of reduced size forward of the constriction portion. A projectile is muzzle loaded and a pre-packaged, hermetically sealed propellant charge having a polymer vessel filled with propellant is breech loaded in the breech chamber. The polymer vessel includes a flange at a rearward end and a primer receptacle centrally positioned at the rearward end. In some embodiments, cooperating features between the rear face of the polymer vessel and the muzzleloader rifle breech block provide means for limiting engagement of the firing pin with only a specifically configured polymer vessel with primer.

In some embodiments, the muzzleloader rifle has a chamber to receive the polymer propellant vessel and a breech block face that presents a most forward extending structure within the axial rearward projection of the chamber, a primer receiving surface on the breech block face that is positioned rearwardly of the forward most extending structure, and a firing pin that does not extend forward past the forward most extending structure. In some embodiments, the forwardmost extending structure is a projection such as one or more pins, or such as an annular projection, that mate with a corresponding recess on the rear face of the propellant vessel. In some embodiments, the forward most structure is a planar breech block face that confronts the breech face around the chamber, and the primer receiving surface of the breech block face is positioned at bottom of a cylindrical recess surrounding a firing pin hole.

In some embodiments, a muzzleloader polymer propellant vessel has a primer recess with a depth that is less than an overall height of the primer so that the primer, when inserted into the primer receptacle, extends rearwardly beyond a rearward facing surface of the propellant containment vessel. The breech block face of the muzzleloader rifle may define a recess sized to receive the projecting primer. The firing pin of the rifle may be configured to not extend beyond a planar face of the breech block surface surrounding the recess. In some embodiments, the rearward face of the propellant vessel has an annular polymer projection defining the primer receptacle portion therein to receive the primer with a flange, the flange seating on the rearward face of the annular polymer projection. The breech block face may define a recess configured to receive a polymer projection and primer installed therein. In some embodiments, the components are configured such that the internal face of the recess of the breech block face is compressively engages the primer flange and polymer projection.

In some embodiments, a rimfire primer is inserted in a primer receptacle and the firing pin hole and firing pin actuation region is offset from the central axis of the chamber. The rimfire primer may extend from the rear face of the polymer vessel or may be seated in a centrally positioned annular projection. In some embodiments, one or more means for limiting engagement of the firing pin with only a specifically configured polymer vessel with primer may be combined.

An example muzzleloader system includes a propellant containment vessel for use with a primer, a projectile and a muzzleloader. In some embodiments, the system includes a propellant containment vessel separate from the primer and the projectile so that the propellant containment vessel is not in contact with the projectile and the primer does not contact the propellant containment vessel until an assembly step has been completed. In some embodiments, the propellant containment vessel is sized to be received in the breech chamber and has a head portion with a flange and a primer receptacle. A body portion may taper toward a forward end with the forward end conformed to engage a constriction portion in the muzzleloader. The propellant vessel may include means for precluding the loading of the vessel into a firearm other than an intended muzzleloader rifle. The muzzleloader rifle may include means for precluding the firing of any ammunition except for an intended and a specifically configured propellant vessel with a primer inserted therein.

In some embodiments, the system is dimensioned and adapted for use with a muzzleloader having a firing pin and a pair of positioning pins. The firing pin may be slideable between a forward-most position and a more rearward position. In some embodiments, the firing pin extends forwardly beyond a forward facing surface of a breech block by a first distance when the firing pin is in the forward-most position. In some embodiments, each positioning pin extends forwardly beyond the forward facing surface of a breech block by a second distance. The second distance may be greater than the first distance so that the firing pin does not extend through a plane defined by the forward most surfaces of the positioning pins when the firing pin is in the forward-most position.

A feature and benefit of various embodiments of the disclosure is a muzzleloader power cell capsule including a rearward portion containing a propellant charge and a forward portion covering a forward opening of the rearward portion. In some embodiments, the forward portion is expelled from the muzzle loader upon ignition of the propellant charge.

A feature and benefit of various embodiments of the disclosure is a muzzleloader system including a power cell containing a propellant charge for use with a bullet that is not attached to the power cell. In some embodiments, the lack of attachment between the power cell and the bullet may provide increased accuracy when the bullet is fired. In some embodiments, the power cell with propellant charge is loaded through the rearward breech end of the barrel and the bullet is loaded through the forward, muzzle end of the barrel.

A feature and benefit of various embodiments of the disclosure is that the breech loading or unloading of the propellant charge allows for safe separation of the propellant charge from the bullet loaded within the barrel. When it is desired to unload the muzzleloader, the propellant containment vessel is removed, unfired, from the breech and the bullet then safely pulled or pushed down the barrel and removed from the muzzleloader without risk of inadvertent or delayed ignition of the propellant charge and subsequent firing of the projectile.

A feature and benefit of various embodiments of the disclosure is a muzzleloader system power cell include a transparent or translucent body portion containing a propellant charge and a cap portion hermetically to the body portion. In some embodiments, the transparent or translucent body portion enables visual inspection of the charge without breaking the hermetic seal. In some embodiments, the cap portions are color coded in a manner representative of types and/or quantities of propellant. The cap can be on the forward or rearward end of the vessel portion.

A feature and benefit of various embodiments of the disclosure is a muzzleloader system including a power cell containing a propellant charge sized and adapted to propel a bullet having a weight greater than 200 grains so as to provide a quick and humane kill when hunting. In some embodiments, the muzzleloader system includes a power cell containing a propellant charge sized and adapted to propel a bullet having a weight greater than 250 grains. In some embodiments, the muzzleloader system includes a power cell containing a propellant charge sized and adapted to propel a bullet having a weight greater than 300 grains. Some embodiments herein are specifically addressed to muzzle-loaded projectiles from 45 caliber to 50 caliber.

A feature and benefit of various embodiments of the disclosure is a muzzleloader system including a power cell containing a propellant charge for use with primer and a bullet, the bullet being sized so that the muzzleloader system is suitable for use in hunting large game such as elk, moose and bear.

The above summary of the various representative embodiments is not intended to describe each or every implementation of the claimed invention. Rather, the embodiments are chosen and described so that others skilled in the art can appreciate and understand the principles and practices disclosed herein. The Figures in the detailed description that follow more particularly exemplify these embodiments.

BRIEF DESCRIPTION OF THE DRAWINGS

The claimed invention can be completely understood in consideration of the following detailed description of various embodiments disclosed herein in connection with the accompanying drawings, in which:

FIG. 8 is a perspective view of the vessel with a primer receptacle for receiving a primer according to an embodiment of the disclosure.

FIG. 9 is a side view of the embodiment of FIGS. 4 and 5 before insertion of a primer according to an embodiment of the disclosure.

FIG. 10 is a side view of the vessel of FIG. 9 with primer insertion according to an embodiment of the disclosure.

FIG. 11 is a side view of a vessel according to an embodiment before primer insertion according to an embodiment of the disclosure.

FIG. 12 is a side view of the vessel of FIG. 11 with primer inserted according to an embodiment of the disclosure.

FIG. 13 is a side view of the vessel of FIGS. 6 and 7 before primer insertion according to an embodiment of the disclosure.

FIG. 14 is a side view of the vessel of FIG. 13 with primer inserted according to an embodiment of the disclosure.

FIG. 18 is a side cross-sectional view of a propellant containment vessel of the muzzleloader power cell of FIG. 15 according to an embodiment of the disclosure.

FIGS. 19A through 19C are cross-sectional elevational views of the muzzleloader power cell of FIG. 15 at various stages of manufacturing according to an embodiment of the disclosure.

FIG. 20 is a perspective view of the muzzleloader power cell of FIG. 15 according to an embodiment of the disclosure.

Figure 1:
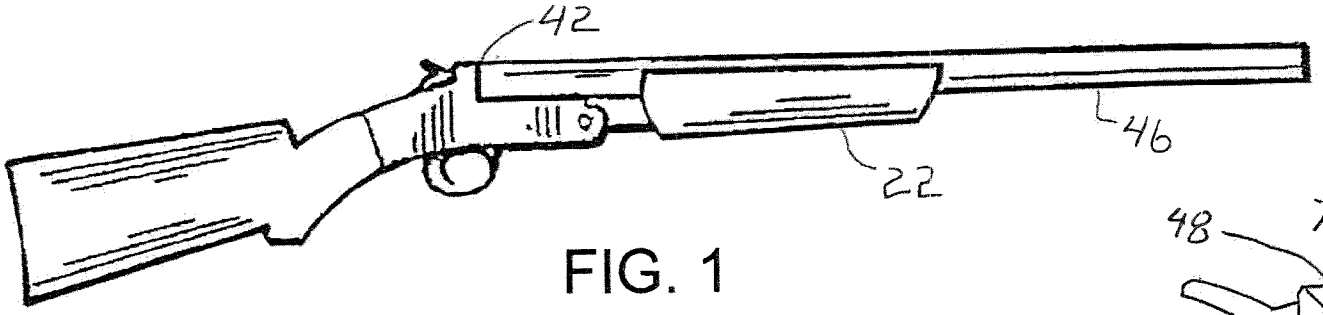
FIG. 1 is a side view of a breech break muzzleloader rifle according to embodiments of the disclosure.

While the disclosed embodiments are amenable to various modifications and alternative forms, specifics thereof have been depicted by way of example in the drawings and will be described in detail. It should be understood, however, that the intention is not to limit the claimed invention to the particular embodiments described. On the contrary, the intention is to cover all modifications, equivalents, and alternatives falling within the spirit and scope of the invention as defined by the appended claims.

DETAILED DESCRIPTION OF THE DRAWINGS

Figure 3:
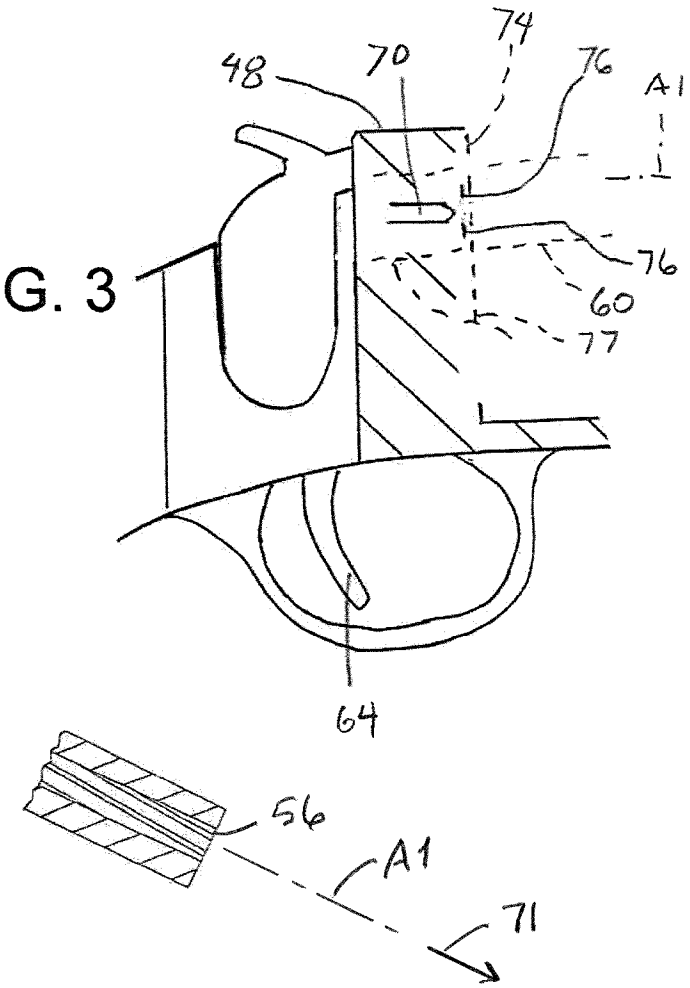
FIG. 3 is a partial cross-sectional side view of a breech block of the muzzleloader rifle of FIG. 1 according to an embodiment of the disclosure.
Figure 2:
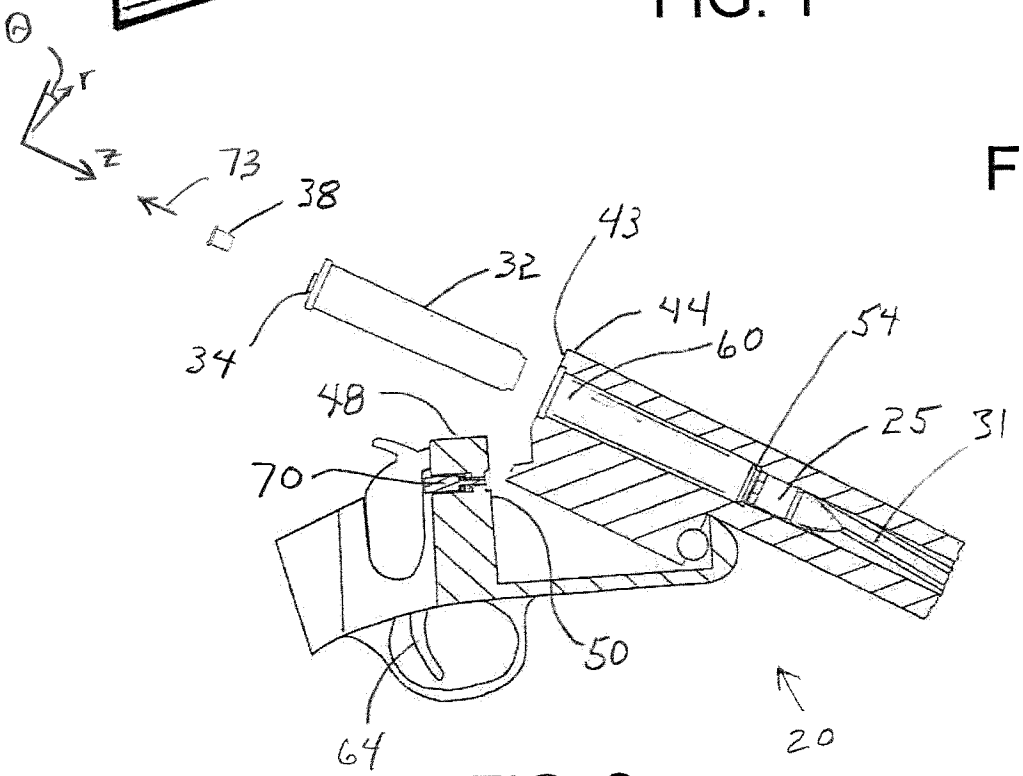
FIG. 2 is a partial cross-sectional side view of the muzzleloader rifle of FIG. 1 illustrating the breech loading of a propellant containment vessel and installation of a primer according to an embodiment of the disclosure.

Referring to FIGS. 1-3, a muzzleloader system 20 includes a muzzleloader rifle 22, a muzzle loaded projectile 25, a breech loaded muzzleloader power cell 32 having a primer receptacle 34, and a primer 38 insertable into the primer receptacle 34 of the muzzleloader power cell 32. The muzzleloader power cell 32 includes a propellant containment vessel 40 that contains a quantity of propellant. In some embodiments, the muzzleloader power cell 32 is separate from the primer 38 and the projectile 25 until the system is ready for firing.

In some embodiments, the muzzleloader 20 has a breech brake 42 that opens as shown in FIG. 2 revealing a breech face 43 of the breech end 44 of a barrel 46. A breech block 48 has a breech block face 50 that confronts the breech face 43. A breech chamber 60 open rearwardly, a constriction portion 54, is positioned forward of the breech chamber 60, and a barrel bore 31 forward of the constriction portion 54 that extends to a muzzle 56. The muzzleloader power cell 32 is sized to be conformingly received in the breech chamber 60. The muzzleloader rifle 22 includes a trigger mechanism 64 for actuating a firing pin 70.

Herein, "forward" and its derivatives (e.g., forwardly, forward-most) is designated by arrow 71 refers to a direction that is parallel to the z-axis of the r-θ-z axis of FIG. 2 and parallel to a direction of the travel of the projectile 25 upon discharge. "Rearward" and its derivatives (e.g., rearwardly, rearward-most) is a direction that is opposite the forward direction 71, designated by arrow 73.

Referring specifically to FIG. 3, In some embodiments, the breech block 48 has two pertinent surfaces that are within a rearward axial projection 72 of the breech chamber 60, one is a forwardly most surface 74, and the other is a primer confronting surface 76 that faces forward and extends around the firing pin opening and the firing pin travel path. In some embodiments, the firing pin travel is constrained to have a forward stop position such that forward travel is precluded beyond a plane 77 perpendicular to the barrel axis A1 positioned at the breech block forwardly most surface 74. In some embodiments, when the muzzleloader is loaded and ready for firing, the breech block forwardly most surface is forward of the rearward-most surface of the propellant vessel with primer 38. The positioning as such limits the firing pin to only strike the specially conformingly configured propellant vessels with primers 38.

Figure 4:
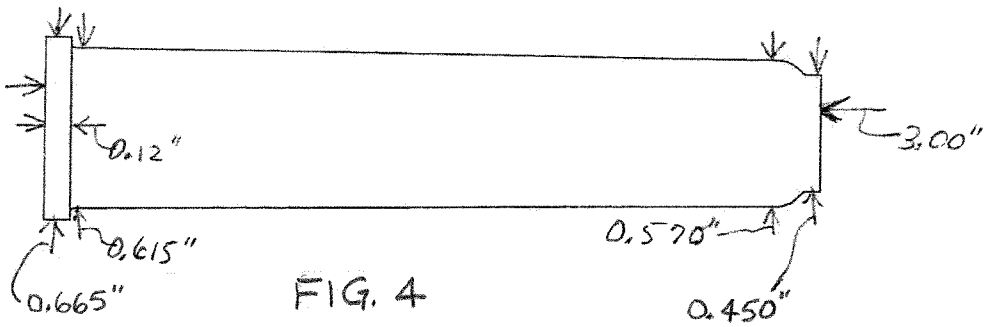
FIG. 4 is a dimensioned propellant containment vessel according to an embodiment of the disclosure.

Referring to FIG. 4 example suitable dimensions for the muzzleloader power cell 32 are presented according to an embodiment of the disclosure. The dimensions presented as an example and are non-limiting. In some embodiments, the dimensions may vary to within 5% of specified values.

Figure 5A:
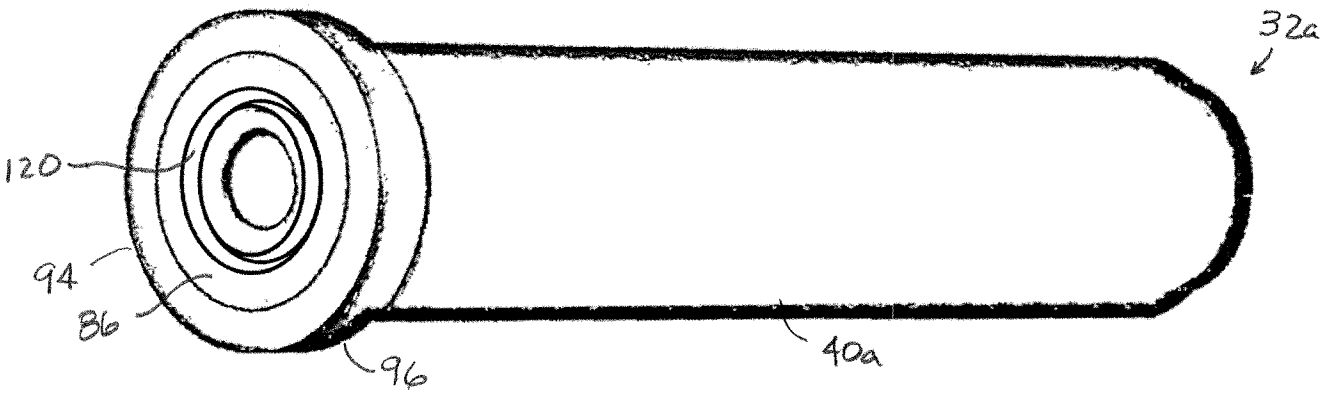
FIG. 5A is perspective view of a propellant containment vessel with a head that defines an annular recess according to an embodiment of the disclosure.
Figure 5B:
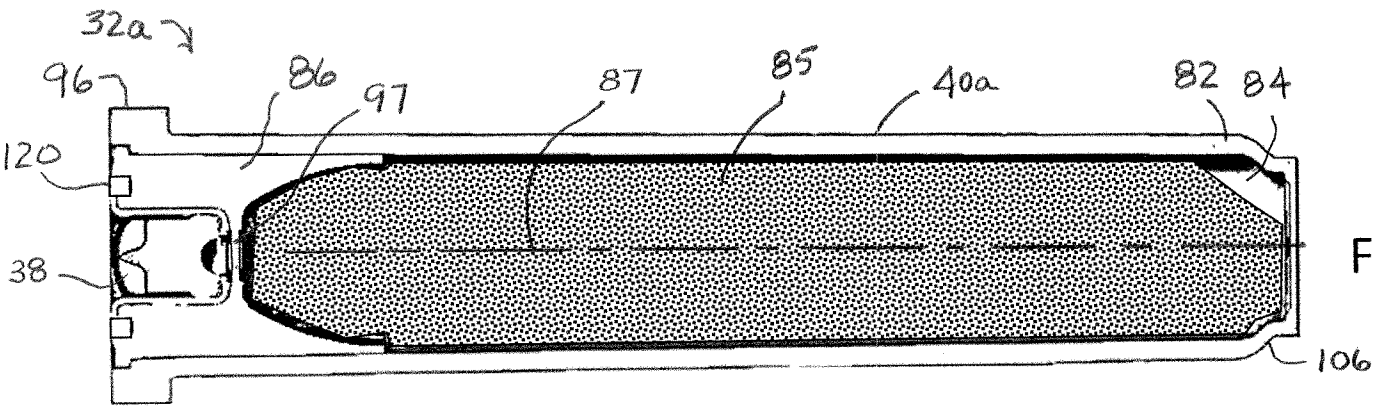
FIG. 5B is a cross-sectional view of a propellant containment vessel of FIG. 5A according to an embodiment of the disclosure.

Referring to FIGS. 5A and 5B, a muzzleloader power cell 32*a* is depicted according to an embodiment of the disclosure. The muzzleloader power cell 32*a* includes a propellant containment vessel 40*a*. Herein, muzzleloader power cells and propellant containment vessels are referred to collectively and generically as "muzzleloader power cell(s) 32" and "propellant containment vessel(s) 40," and specifically or individually by the reference characters 32 and 40, respectively, followed by a letter suffix (e.g., "muzzleloader power cell 32*a*" and "propellant containment vessel 40*a*"). The propellant containment vessel 40*a* includes a forward body portion 82 that includes a tubular wall portion 83, the forward body portion 82 defining a cavity 84 that contains a quantity or charge of propellant 85. The forward body portion 82 extends rearwardly from a forward end portion 106, concentric about the body axis 87 to and defines a rearward mouth 87. A rearward cup 86 is disposed in the rearward mouth 87 that closes and seals the propellant 85 within the cavity 84. Certain aspects of the configuration of FIGS. 5A and 5B are further explained in International Patent Application Publication WO 2019/144161, owned by the assignee of the current application, the contents of which are hereby incorporated by reference herein in its entirety except for patent claims and express definitions contained therein.

Figure 6:
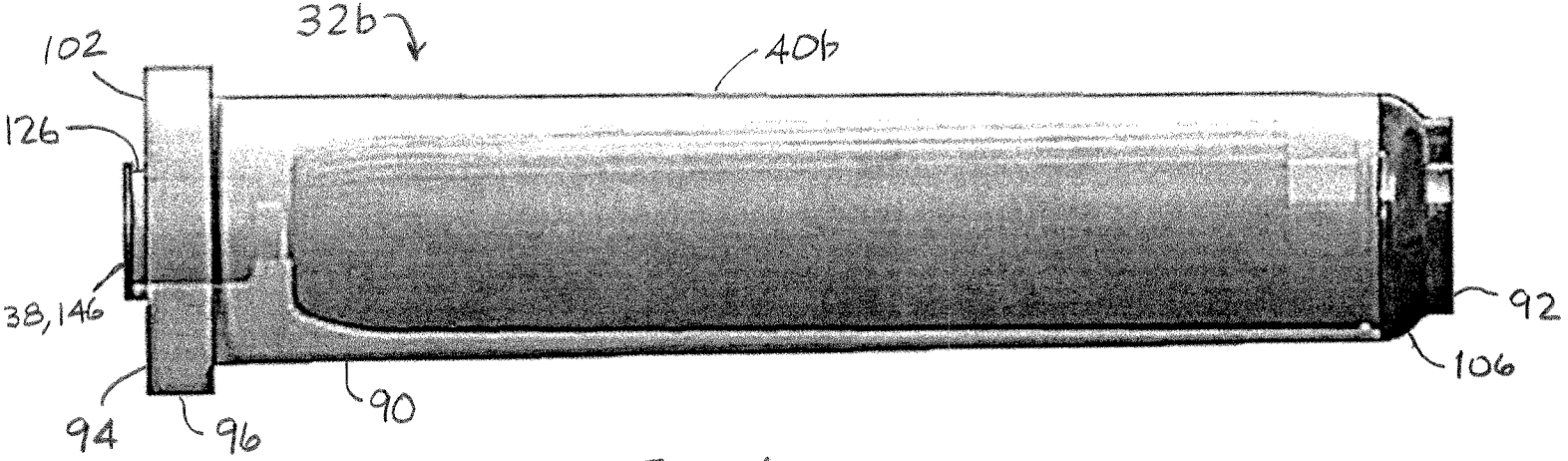
FIG. 6 is a side view of a propellant vessel in accord with embodiments according to an embodiment of the disclosure.
Figure 7:
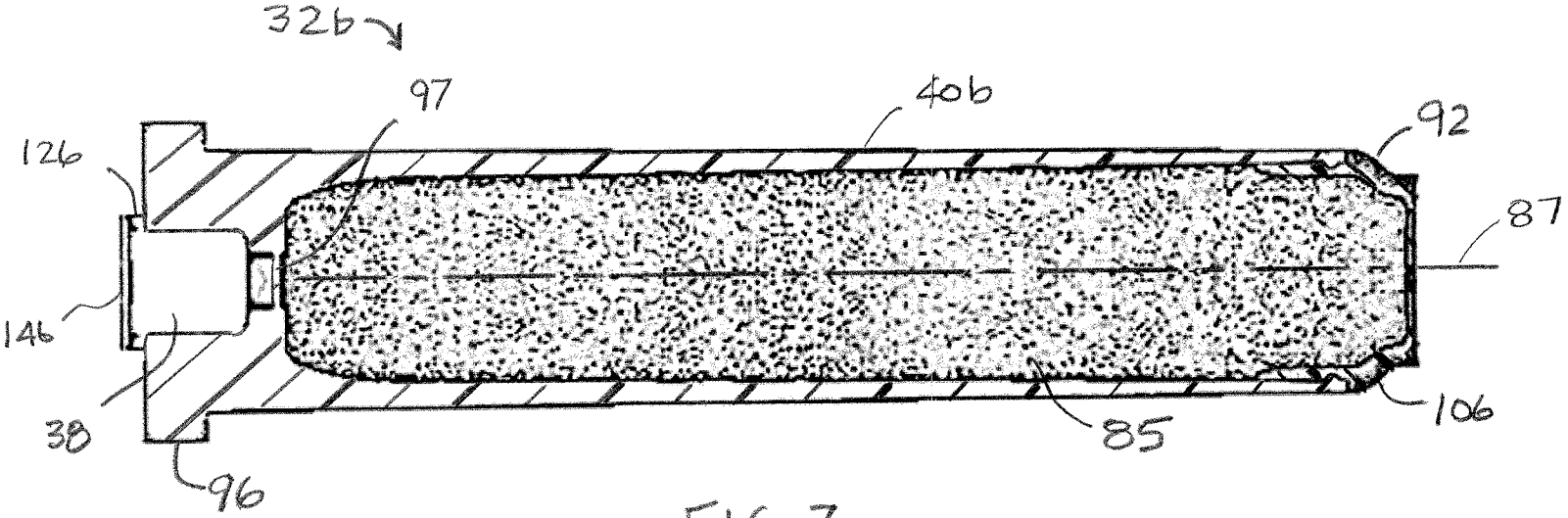
FIG. 7 is a cross-sectional view of the vessel of FIG. 6 depicting transparency of the vessel portion according to an embodiment of the disclosure.

Referring to FIGS. 6 and 7, a muzzleloader power cell 32*b* is depicted according to an embodiment of the disclosure. The muzzleloader power cell 32*b* includes some of the same components and attributes as the muzzleloader power cell 32*a*, which are identified with same-numbered reference characters. The muzzleloader power cell 32*b* includes a propellant containment vessel 40*a* having a rearward body portion 90 that defines the cavity 84 and extends forwardly to and defines a forward mouth 91. The forward mouth 91 is configured to receive a forward cap 92 to seal the propellant 85 therein.

Referring to FIGS. 8 through 14 and again to FIGS. 4 through 7, propellant containment vessels 80 include a rearward or head end portion 94 with a flange 96 that defines a primer receptacle 98 defining a primer recess 99, and a rearward flange face 102. A membrane 97 isolates the cavity 84 and the primer recess 99 so that, prior to discharge, there is no fluid communication between the cavity 84 and the primer recess 99. The forward end portion 106 of the muzzleloader power cell 32 is shaped to conform to the constriction portion 54 of the muzzleloader rifle 22.

Figure 21:
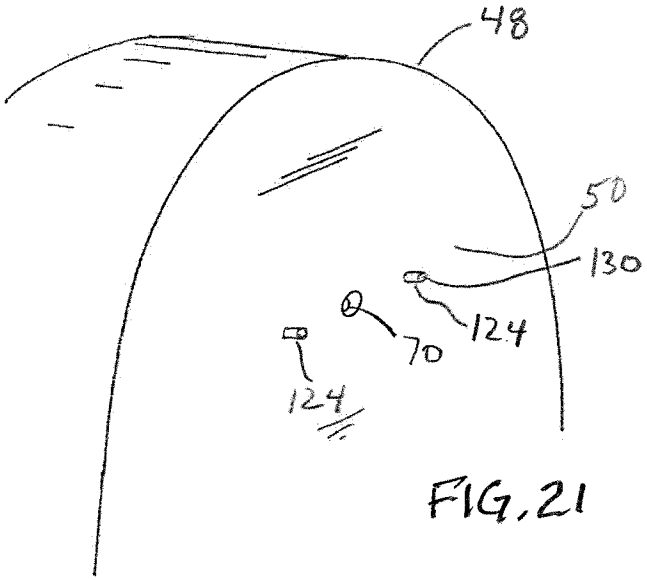
FIG. 21 is a simplified perspective view of a breech block having projecting pins for mating with the annular recess of the propellant vessel of FIGS. 5A and 5B according to an embodiment of the disclosure.
Figure 22:
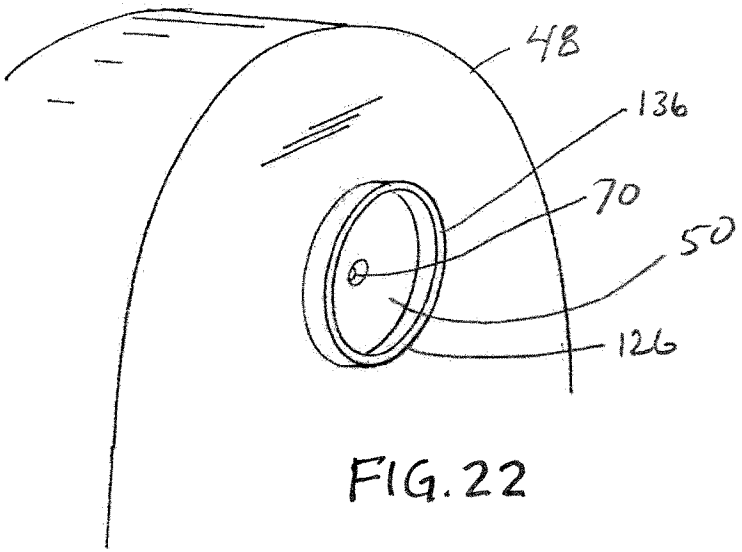
FIG. 22 is a simplified perspective view of a breech block having an annular projection for mating with the annular recess of the propellant vessel of FIGS. 5A and 5B according to an embodiment of the disclosure.

Referring to FIGS. 9 and 10 and again to FIGS. 5A and 5B, muzzleloader power cells 32*a* and 32*b* are depicted according to embodiments of the disclosure. The muzzleloader power cells 32*a* and 32*b* include propellant containment vessels 40*a* and 40*b*, each defining an annular recess 120 for receiving cooperating structures 122 (FIGS. 21 and 22) on the breech block face 50. The cooperating structures 122 may include, for example, pins 124 (FIG. 21) or an annular projection 126 (FIG. 22). In such arrangements, an end surface 130 of the pins 124 and a rearward extremity 136 of the annular projection 126 constitute the forward-most surfaces 74 of the breech block face 50 as described above. The firing pin 70 is configured so as not to extend forward of the forward-most surfaces 74 when actuated.

Referring to FIGS. 11 and 12, in some embodiments, the recess 99 of the primer receptacle 98 of the propellant containment vessel 40 has a depth D that is less than an overall height H of the primer 38 so that the primer 38, such that when inserted into the primer receptacle 98, the primer 38 including a primer flange 146, extends rearwardly beyond the rearward-facing flange face 102 of the propellant containment vessel 32. In some embodiments, the muzzleloader system includes means that preclude the firing of a rifle cartridge by the muzzleloader 20.

Referring to FIGS. 13 and 14, the flange 96 includes the annular projection 126 with the primer recess 99 being defined therein. The annular projection extends an axial length L1 beyond the rearward flange face 102 of the flange 96 in the rearward direction 73. Upon installation of the primer 38, the annular projection 126 and the primer flange 146 of the primer 36 stack up to project rearwardly, defining an axial length L2 relative to the rearward flange face 102 of the flange 96.

Figure 16:
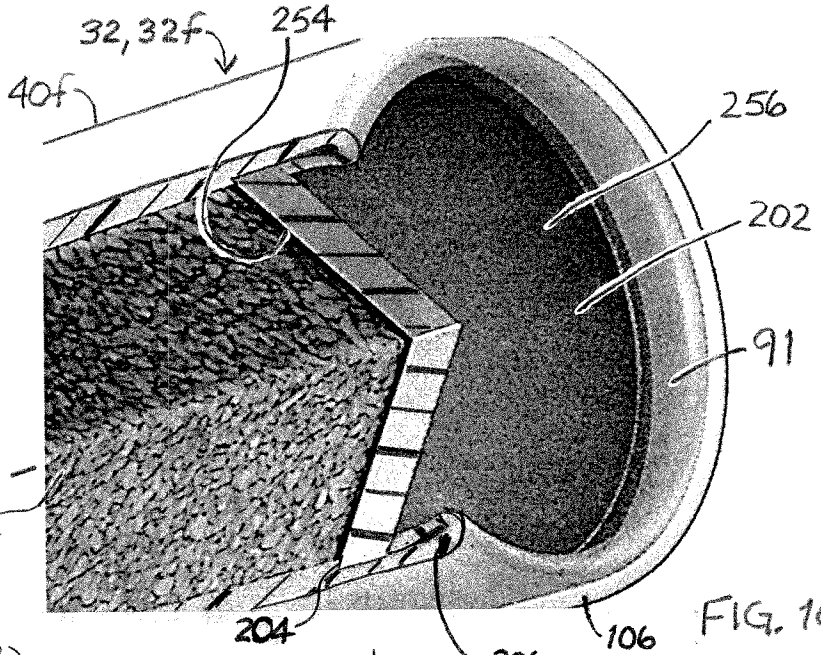
FIG. 16 is an enlarged, partial view of the forward end of the muzzleloader power cell of FIG. 15 according to an embodiment of the disclosure.
Figure 15:
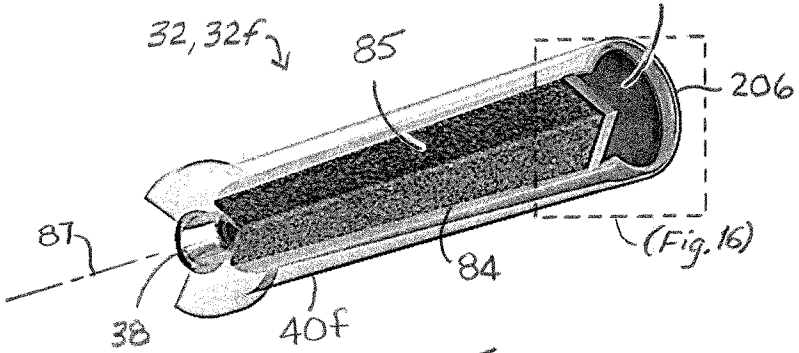
FIG. 15 is a perspective cutaway view of a muzzleloader power cell including an over-powder disk secured with roll crimps according to an embodiment of the disclosure.
Figure 17:
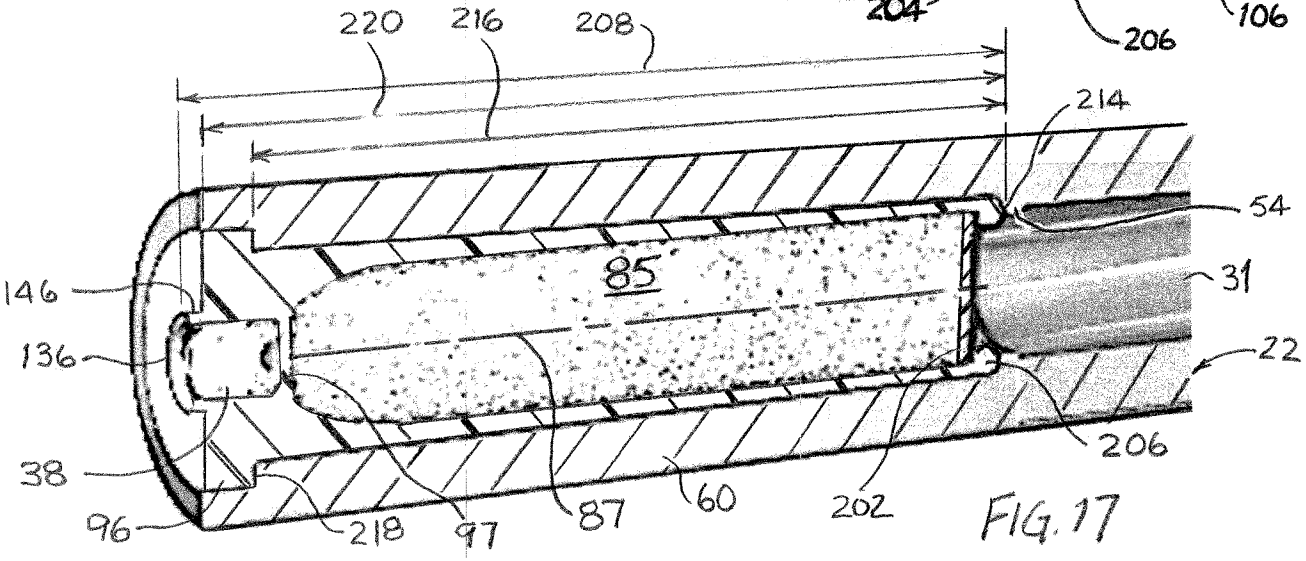
FIG. 17 is a partial, perspective cross-sectional view of the muzzleloader power cell of FIG. 15 loaded in a breech chamber of the muzzleloader rifle of FIGS. 1 through 3 according to an embodiment of the disclosure.
Figure 23:
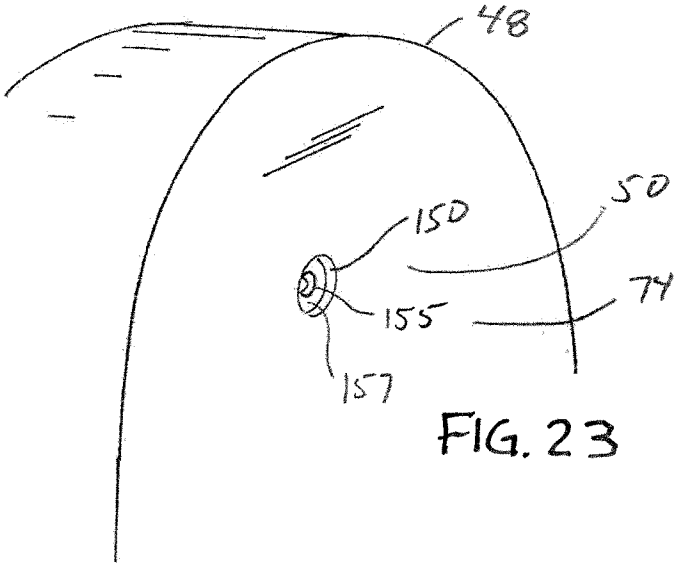
FIG. 23 is a simplified perspective view of a breech block defining a recess for receiving the rearward projecting primer of the propellant vessel of FIGS. 12 and 14 according to an embodiment of the disclosure.

Referring to FIGS. 15 through 17, a muzzleloader power cell 32*f* including an over-powder disk secured with roll crimps is depicted according to an embodiment of the disclosure. The muzzleloader power cell 32*f* includes several of the same components and attributes as the muzzleloader power cell 32*e*, some of which are indicated with same-numbered reference characters. The muzzleloader power cell 32*f* includes a propellant containment vessel 40*f*, primer 38, propellant 85, and an over-powder disk 202 coupled to the forward mouth 91. The propellant containment vessel 40*f* may be of a transparent or translucent material (depicted), as discussed above. The over-powder disk 202 is captured at the forward end 106 of the propellant containment vessel 40*f* between a ledge portion 204 and a roll crimp 206 of the propellant containment vessel 40*f* to close and seal the propellant 85 within the cavity 84.

The muzzleloader power cell 32*f* defines an overall axial length 208, extending from a rearward extremity 212 of the annular projection 146 to a forward extremity 214 of the roll crimp 206 of the propellant containment vessel 40*f*. The propellant containment vessel 40*f* defines a body axial length 216 that extends from a forward face 218 of the flange 96 to the forward extremity 214 of the roll crimp 206, and also defines a breech chamber axial insertion length 220 that extends from a rearward face of the flange 96 to the forward extremity 214 of the roll crimp 206. In operation, the muzzleloader power cell 32*f* is inserted into the breech chamber 60 so that the roll crimp 206 registers against the constriction portion 54 of the muzzleloader rifle 22.

Referring to FIG. 18, the propellant containment vessel 40*f* is depicted prior to assembly of the muzzleloader power cell 32*f* according to an embodiment of the disclosure. The propellant containment vessel 40*f* is a unitary polymer structure 232 that includes the flange 96, primer receptacle 98, and membrane 97 at the rearward end portion 94. At the forward end portion 106, the propellant containment vessel 40*f* defines the ledge portion 204 that is rearward of the forward mouth 91, the ledge portion 204 projecting radially inward (i.e., toward the body axis 87) from an interior surface 236 of the tubular wall portion 83 of the propellant containment vessel 40*f* The ledge portion 204 defines a seating face 238 that faces forwardly, toward the forward mouth 91. In some embodiments, the ledge portion 204 is a continuous annular ledge. In some embodiments, the ledge portion 204 is a shoulder 242 (depicted) that transitions between a proximal thick wall portion 244 and a distal thin wall portion 246 of the tubular wall portion 83. In some embodiments, an exterior surface 248 the tubular wall portion 83 of the propellant containment vessel 40*f* (as well as for propellant containment vessels 40 generally) tapers toward the body axis 87 in the forward direction 71.

The unitary polymer structure 232 of the propellant containment vessel 40*f* (as well as for propellant containment vessels 40 generally) may be fabricated by techniques known to the artisan, such as injection molding, machining, or a combination thereof. For example, the unitary polymer structure 232 may be initially cast by an injection molding technique that is finished by machining techniques to provide tighter tolerances of critical surfaces and lengths (e.g., the seating face 238 of the ledge portion 204, the rearward flange face 102, the axial length L1 to the rearward extremity 136 of the annular projection 126, and/or a thickness of the distal thin wall portion 246). The over-powder disk 202 may be manufactured, for example, from a polymer or cardboard.

Functionally, the annular projection 126 provides the same safety aspects as with the muzzleloader cell 32*e*, described above attendant to FIGS. 13 and 14. The membrane 97 prevents propellant 85 from leaking out of the cavity 84 into the primer receptacle 98 during shipping, storage, and handling. The ledge portion 204 provides a reliable seating position along the body axis 87 for the over-powder disk 202, and cooperates with the roll crimp 206 to secure the over-powder disk 202 and seal the cavity 84. The distal thin wall portion 246 can enable easier and more reliable formation of the crimp roll 206, while providing the proximal thick wall portion 244 provides the necessary structural integrity of the propellant containment vessel 40*f* to avoid rupture of the muzzleloader power cell 32*f* during discharge. The taper of the exterior surface 248 may conform to a complementary-shaped interior wall of the breech chamber 60 for better support of the muzzleloader power cells 32 (and muzzleloader power cells 32 generally) during discharge.

Referring to FIGS. 19A through 19C, a process for manufacturing the muzzleloader power cell 32*f* is depicted according to an embodiment of the disclosure. A depiction of the fully assembled power cell 32*f* is depicted at FIG. 20. The unitary polymer structure 232 of the propellant containment vessel 40*f* may undergo the fabrication and finishing processes described above attendant to FIG. 18. The propellant 85 is disposed in the rearward body portion 90 of the unitary polymer structure 232 (FIG. 19A). The over-powder disk 202 is inserted into the forward mouth 91 so that a rearward face 252 of the over-powder disk 202 is seated on the ledge portion 204 of the propellant containment vessel 40*f* (FIG. 19B). The propellant containment vessel 40*f* with propellant 85 and over-powder disk 202 inserted undergoes a roll crimping process, for example with a roll crimping tool 254 inserted in the forward mouth 91 (FIG. 19C). The roll crimping process forms the roll crimp 206, bringing the roll crimp 206 into contact with a forward face 256 of the over-powder disk 202, thereby tightly securing the over-powder disk 202 within the forward mouth 91 of the propellant containment vessel 40*f*.

Referring to FIGS. 11 through 14 and 23, the rearward central projections are sized to fit a recess 150 defined in the breech block face 50 about the firing pin hole 155. A primer confrontation and engagement surface 157 is at the bottom of the recess and extends about the firing pin hole 155. In this embodiment, the breech block face 50 is the forward most surface 74 of the breech block and the firing pin 70 does not extend past the plane defined by this surface. Functionally, standard cartridges with primers that are flush with a rearward face of the cartridge cannot be fired in this arrangement, because the firing pin 70 does not reach the primer.

Figure 24:
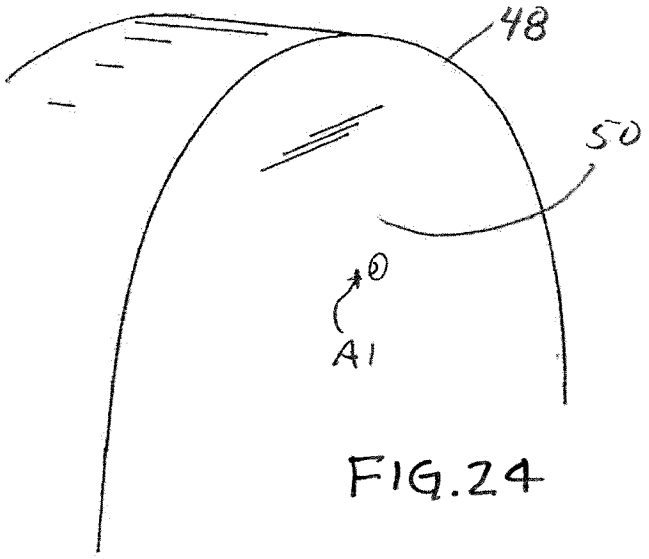
FIG. 24 is a simplified perspective view of a breech block having an off-center firing pin for rimfire primers according to an embodiment of the disclosure.

Referring to FIG. 24, a breech block firing pin arrangement may be utilized with propellant containment vessels embodiments by substituting a rimfire primer for the conventional centerfire primers. The firing pin is offset from the intersection of the central axis A1 of the barrel with the breech block face 50 when the muzzleloader is closed. The position such that the firing pin will strike the rim of a centrally positioned rim fire primer.

Figure 25:
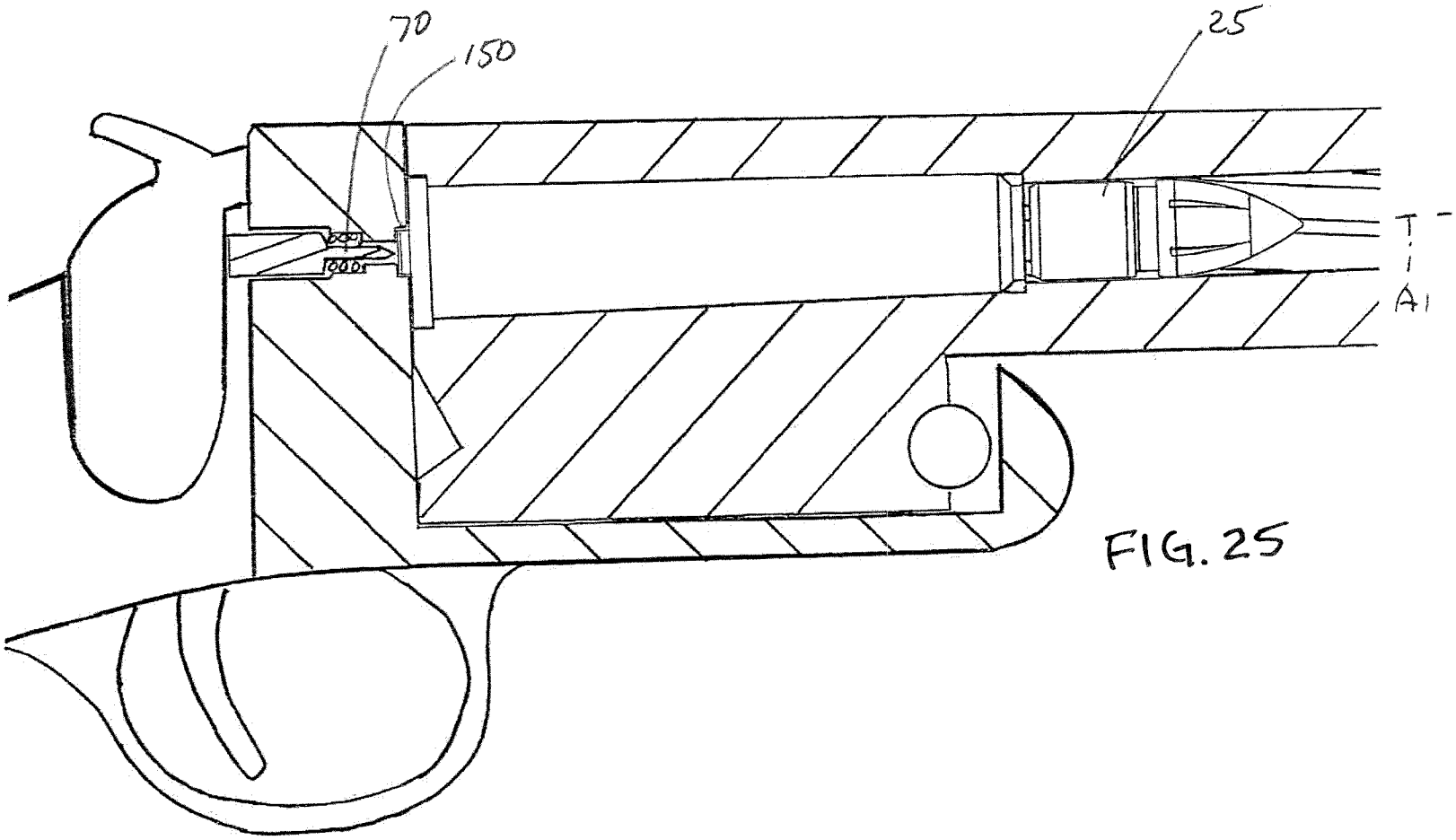
FIG. 25 is a partial cross-sectional side view of the muzzleloader rifle of FIG. 1 illustrating the embodiments of FIGS. 13, 14, and 23 in a loaded and pre-fired configuration according to an embodiment of the disclosure.
Figure 26:
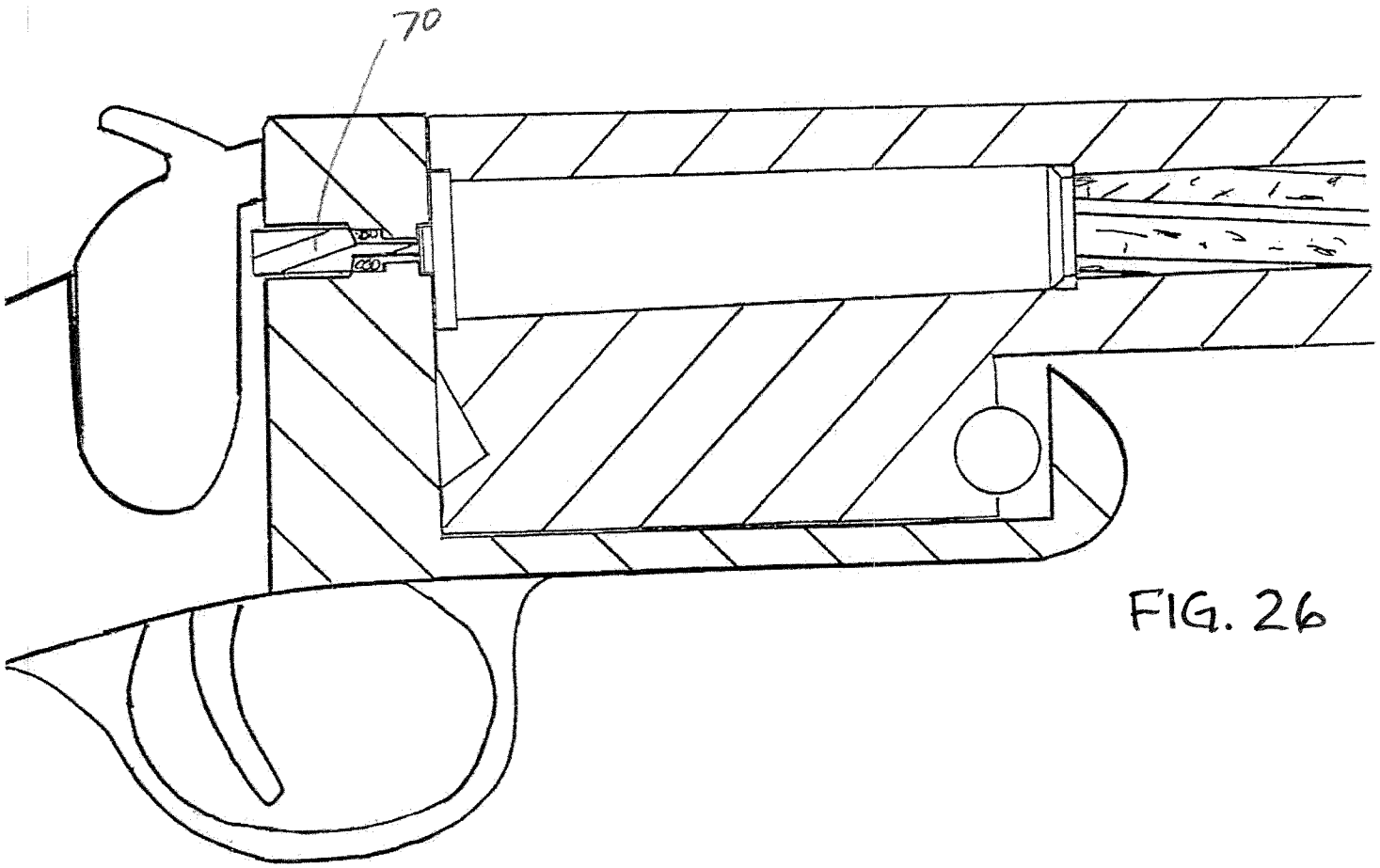
FIG. 26 is the partial cross-sectional side view of FIG. 25 after discharge with the projectile having left the seated position according to an embodiment of the disclosure.
Figure 27:
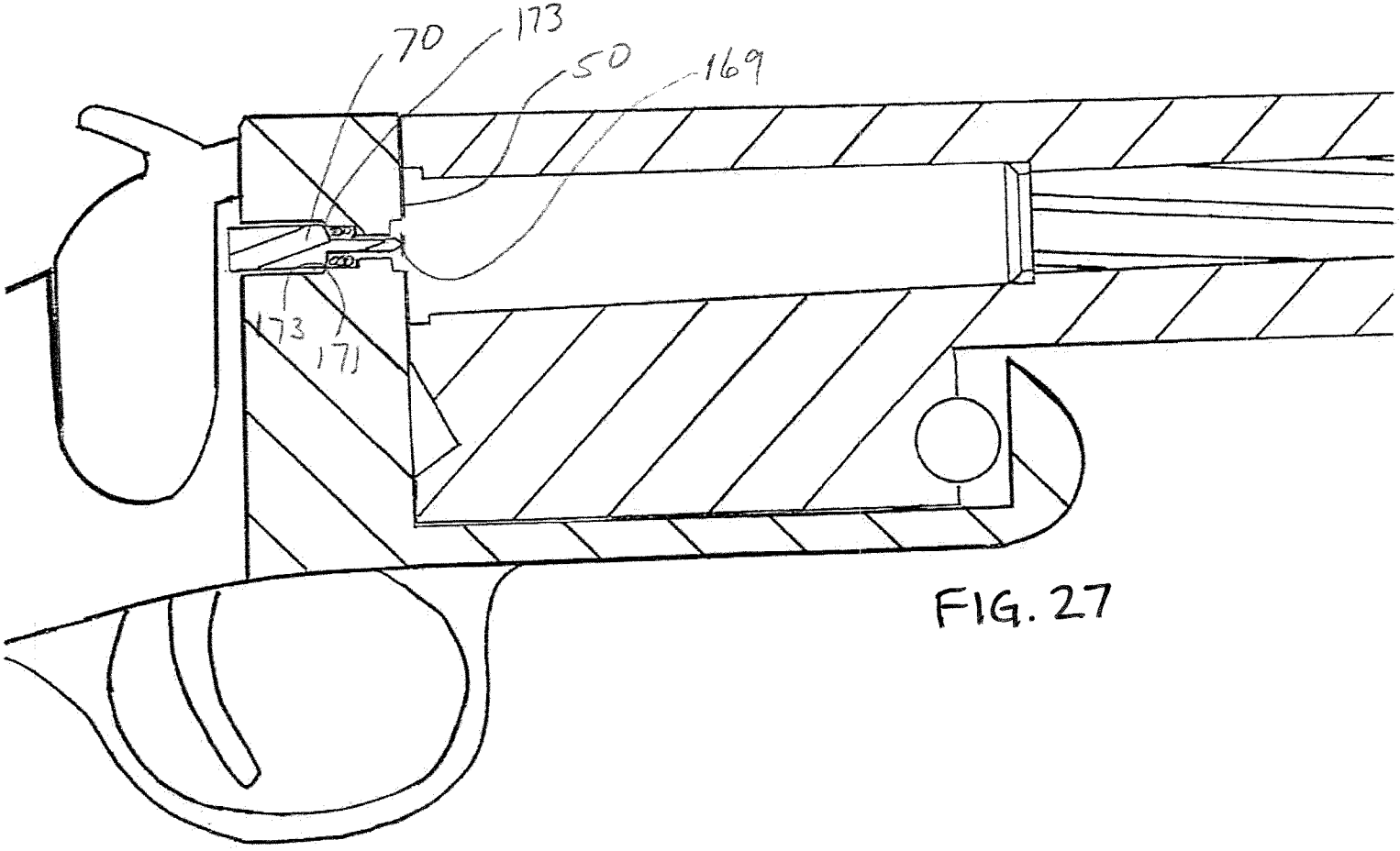
FIG. 27 is the partial cross-sectional side view of FIG. 25 with an empty breech and the firing pin fully extended according to an embodiment of the disclosure.

Referring to FIGS. 25 through 27, the firing pin 70 travel is illustrated in accord with embodiments. FIG. 25 the muzzleloader is loaded with a bullet, a propellant containment vessel, and a primer. The primer flange and rear face projecting into a recess 150 in the breech block face 50. FIG. 26 shows the firing pin impacting the primer causing ignition of the propellant in the propellant containment vessel and launching the bullet. FIG. 27 illustrates the end stop 169 of forward travel of the firing pin 70 without a propellant containment vessel in the breech chamber 60. Said travel does not extend past the plane defined by the breech face. Stop surfaces 171 on the breech block engaging with surfaces 173*d* on the firing pin may provide such an end stop 169.

The following United States patents are hereby incorporated by reference herein in their entirety except for patent claims and express definitions contained therein: U.S. Pat. Nos. 9,273,941; 9,261,335; 9,003,973; 8,875,633; 8,869,702; 8,763,535; 8,726,560; 8,590,199; 8,573,126; 8,561,543; 8,453,367; 8,443,730; 8,240,252; 8,146,505; 7,984,668; 7,621,208; 7,444,775; 7,441,504; 7,302,890; 7,278,358; 7,225,741; 7,059,234; 6,931,978; 6,845,716; 6,752,084; 6,625,916; 6,564,719; 6,439,123; 6,178,889; 5,677,505; 5,492,063; 5,359,937; 5,216,199; 4,955,157; 4,169,329; 4,098,016; 4,069,608; 4,058,922; 4,057,003; 3,776,095; 3,771,415; and 3,261,291. Components and features illustrated in the incorporated by reference references may be utilized with embodiments herein. Incorporation by reference is discussed, for example, in MPEP section 2163.07 (B).

All of the features disclosed, claimed, and incorporated by reference herein, and all of the steps of any method or process so disclosed, may be combined in any combination, except combinations where at least some of such features and/or steps are mutually exclusive. Each feature disclosed in this specification may be replaced by alternative features serving the same, equivalent or similar purpose, unless expressly stated otherwise. Thus, unless expressly stated otherwise, each feature disclosed is an example only of a generic series of equivalent or similar features. Inventive aspects of this disclosure are not restricted to the details of the foregoing embodiments, but rather extend to any novel embodiment, or any novel combination of embodiments, of the features presented in this disclosure, and to any novel embodiment, or any novel combination of embodiments, of the steps of any method or process so disclosed.

Although specific examples have been illustrated and described herein, it will be appreciated by those of ordinary skill in the art that any arrangement calculated to achieve the same purpose could be substituted for the specific examples disclosed. This application is intended to cover adaptations or variations of the present subject matter. Moreover, the embodiments herein may have applicability to other types of firearms. Therefore, it is intended that the invention be defined by the attached claims and their legal equivalents, as well as the illustrative aspects. The above described embodiments are merely descriptive of its principles and are not to be considered limiting.

What is claimed is:

1. A muzzleloader rifle, comprising:

a breech block that comprises a breech block face about a firing pin hole, and a recess in the breech block face configured to receive a portion of a primer, a barrel a breech chamber that opens rearwardly, a constriction portion forward of the breech chamber, and a barrel bore forward of the constriction portion, the barrel bore extending to a muzzle of the muzzleloader rifle and comprising a reduced diameter relative to a diameter of the breech chamber;

wherein the muzzleloader rifle is configured to receive a propellant containment vessel in the breech chamber, the propellant containment vessel being configured for rearward loading into the breech chamber and comprising a rearward-facing face at a rearward end and defining a primer receptacle, the primer receptacle comprising a depth that is less than an overall height of a primer configured to be used with the propellant containment vessel, such that when inserted into the primer receptacle the primer extends rearwardly beyond the rearward-facing flange face of the propellant containment vessel.

2. The muzzleloader rifle of claim 1, the barrel configured to receive a projectile sized for the barrel bore and configured for loading through the muzzle of the muzzleloader rifle.

3. The muzzleloader rifle of claim 1 wherein a firing pin of the muzzleloader rifle is precluded from extending forwardly past a plane of the face of the breech block.

4. The muzzleloader rifle of claim 1, wherein the muzzleloader rifle is capable of receiving a cartridge in the breech chamber, the cartridge comprising a rearward face and a primer being flush with the rearward face, and wherein a firing pin of the muzzleloader rifle is configured such that when fully extended forwardly it will not strike the primer of the cartridge.

5. The muzzleloader rifle of claim 1, wherein the propellant containment vessel comprises a polymer.

6. The muzzleloader rifle of claim 1, wherein the muzzleloader rifle is configured to receive the propellant containment vessel in the breech chamber, the propellant containment vessel being configured for rearward loading into the breech chamber and comprising a flange comprising a rearward-facing flange face at a rearward end and defining the primer receptacle.

7. The muzzleloader rifle of claim 6, wherein the muzzleloader rifle is configured to accommodate the flange of the propellant containment vessel within the muzzleloader rifle when the muzzleloader rifle is closed.

8. The muzzleloader rifle of claim 6, wherein the breech chamber comprises an annular recess configured to receive the flange of the propellant containment vessel.

9. The muzzleloader rifle of claim 1, wherein the breech chamber comprises a taper of an interior wall configured to correspond to a taper of an exterior surface of the propellant containment vessel.

10. The muzzleloader rifle of claim 1, where the constriction portion comprises a smaller diameter than the breech chamber and the barrel.

11. The muzzleloader rifle of claim 1, where the constriction portion is configured to comprise a smaller diameter than the propellant containment vessel and a bullet having a caliber of the muzzleloader rifle.

12. The muzzleloader rifle of claim 1, where the muzzleloader rifle comprises a breech action.

13. The muzzleloader rifle of claim 1, wherein the propellant containment vessel comprises a prepackaged propellant charge and is configured to propel a bullet having a weight greater than 200 grains.

14. The muzzleloader rifle of claim 1, wherein the propellant containment vessel comprises the entire propellant charge.

15. A muzzleloader rifle, comprising:

a breech block that comprises a breech block face about a firing pin hole comprising a cooperating structure, the cooperating structure having a forward-most surface, a firing pin, a barrel, a breech chamber that opens rearwardly, a constriction portion forward of the breech chamber, and a barrel bore forward of the constriction portion, the barrel bore extending to a muzzle of the muzzleloader rifle and comprising an increased diameter relative to a diameter of the constriction portion;

wherein the muzzleloader rifle is configured to receive a propellant containment vessel in the breech chamber, the propellant containment vessel being configured for rearward loading into the breech chamber and comprising a rearward-facing face at a rearward end configured for receiving the cooperating structure;

wherein the firing pin is configured so as not to extend forward of the forward-most surface.

16. The muzzleloader rifle of claim 15, the cooperating structure selected from one of at least one pin, an annular projection, and a recess.

17. The muzzleloader rifle of claim 15, the barrel configured to receive a projectile sized for the barrel bore and configured for loading through the muzzle of the muzzleloader rifle.

18. The muzzleloader rifle of claim 15, wherein the muzzleloader rifle is configured to receive the propellant containment vessel in the breech chamber, the propellant containment vessel being configured for rearward loading into the breech chamber and comprising a flange comprising a rearward-facing flange face at a rearward end and defining a primer receptacle.

19. The muzzleloader rifle of claim 18, wherein the muzzleloader rifle is configured to accommodate the flange of the propellant containment vessel within the muzzleloader rifle when the muzzleloader rifle is closed.

20. The muzzleloader rifle of claim 18, wherein the breech chamber comprises an annular recess configured to receive the flange of the propellant containment vessel.

21. The muzzleloader rifle of claim 15, where the constriction portion comprises a smaller diameter than the breech chamber and the barrel.

22. The muzzleloader rifle of claim 15, where the muzzleloader rifle comprises a breech action.

23. The muzzleloader rifle of claim 15, wherein the propellant containment vessel comprises a prepackaged propellant charge and is configured to propel a bullet having a weight greater than 200 grains.

24. The muzzleloader rifle of claim 15, wherein the propellant containment vessel comprises the entire propellant charge.

25. A muzzleloader rifle, comprising:

a breech block that comprises:

a breech block face about a firing pin hole, and a recess in the breech block face configured to receive a portion of a primer, a barrel, a breech chamber that opens rearwardly, a constriction portion forward of the breech chamber, and a barrel bore forward of the constriction portion, the barrel bore extending to a muzzle of the muzzleloader rifle and comprising an increased diameter relative to a diameter of the constriction portion;

wherein the muzzleloader rifle is configured to receive a propellant containment vessel in the breech chamber, the propellant containment vessel being configured for rearward loading into the breech chamber and comprising a rearward-facing face at a rearward end and defining a primer receptacle, the primer receptacle comprising a depth that is less than an overall height of a primer configured to be used with the propellant containment vessel, such that when inserted into the primer receptacle the primer extends rearwardly beyond the rearward-facing flange face of the propellant containment vessel.

* * * * *